US006983963B2

(12) United States Patent
Eslick et al.

(10) Patent No.: US 6,983,963 B2
(45) Date of Patent: Jan. 10, 2006

(54) FORCED ENTRY RESISTANCE DEVICE FOR SASH LOCK

(75) Inventors: Vincent F. Eslick, Chicago, IL (US); Mark B. Eenigenburg, Lansing, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/351,982

(22) Filed: Jan. 27, 2003

(65) Prior Publication Data

US 2003/0155777 A1 Aug. 21, 2003

Related U.S. Application Data

(60) Provisional application No. 60/352,701, filed on Jan. 29, 2002.

(51) Int. Cl.
*E05C 3/14* (2006.01)

(52) U.S. Cl. ..... 292/242; 292/209; 292/DIG. 47

(58) Field of Classification Search ..... 292/240, 292/242, 241, DIG. 20, DIG. 47, 209, 210
See application file for complete search history.

(56) References Cited

U.S. PATENT DOCUMENTS

| | | | |
|---|---|---|---|
| 115,781 | A | 6/1871 | Steele |
| 201,146 | A | 3/1878 | Adler |
| 215,125 | A | 5/1879 | Hunter |
| 234,387 | A | 11/1880 | Burgess et al. |
| 284,993 | A | 9/1883 | Abele |
| 336,302 | A | 2/1886 | Dudgeon |
| 353,287 | A | 11/1886 | Chumard |
| 480,148 | A | 8/1892 | Theby |

(Continued)

FOREIGN PATENT DOCUMENTS

| | | |
|---|---|---|
| GB | 341207 | 1/1931 |

(Continued)

OTHER PUBLICATIONS

Page 21, Home Protection Hardware Catalog Price List, dated Jul. 1986.

*Primary Examiner*—Gary Estremsky
(74) *Attorney, Agent, or Firm*—Wallenstein Wagner & Rockey, Ltd.

(57) ABSTRACT

A sash lock (10) for a sash window assembly (12) is provided. The sash window assembly (12) includes an upper sash window (14) and a lower sash window (16), each of the sash windows (14), (16) mounted within opposed guide rails (18) on a master frame (20), wherein at least one of the sash windows (14), (16) is slidable within the frame (20) relative to the other sash window (14), (16). The sash lock (10) of the present invention includes a keeper (22) adapted for mounting on one of the sash windows (14), (16). The keeper (22) includes a keeper surface. The sash lock (10) also includes a locking assembly (24) adapted for mounting on the other of the sash windows (14), (16). The locking assembly (24) comprises a housing (30) having an aperture (33), an actuator arm (32) rotatable between an unlocked position and a locked position and a cam (34) having a cam surface (40) for engaging the keeper surface. A shaft (35) is also provided extending through the aperture (33) and coupling the actuator arm (32) to the cam (34) such that the actuator arm (32) and cam (34) are rotatably mounted to the housing (30). A tab (44) mounted to the housing is also provided wherein the tab (44) engages the actuator arm (32) to retain the actuator arm (32) in its locked position.

18 Claims, 6 Drawing Sheets

U.S. PATENT DOCUMENTS 564,426 A 7/1896 Hubbard
587,424 A * 8/1897 Bonine ..... 292/210
743,716 A * 11/1903 Hadka ..... 292/242
744,755 A 11/1903 Hasenpflug
756,559 A 4/1904 Arens
878,206 A 2/1908 Johnson
900,079 A 10/1908 Bittorf
910,850 A 1/1909 Petrie
928,408 A 7/1909 Taube
1,041,803 A 10/1912 Kilburn
1,059,999 A 4/1913 James et al.
1,122,026 A 12/1914 O'Rourke
1,148,712 A 8/1915 Overand
1,156,004 A 10/1915 Fuller
1,247,182 A 11/1917 Tueckmantel
1,253,810 A 1/1918 Gianninoto
1,338,250 A 4/1920 Parkes
1,338,416 A 4/1920 Bellinger
1,339,362 A 5/1920 L'Heureux
1,393,628 A 10/1921 Leichter
1,550,532 A 8/1925 French
1,692,579 A 11/1928 Schrader
1,704,946 A 3/1929 Lindgren
1,790,816 A 2/1931 Hiering
1,900,936 A 3/1933 Huttger
1,901,974 A 3/1933 Macy
2,537,736 A 1/1951 Carlson
2,605,125 A 7/1952 Emerson
2,758,862 A 8/1956 Endter
3,027,188 A 3/1962 Eichstadt
3,135,542 A 6/1964 Wilkinson
3,377,093 A 4/1968 Macoicz
3,438,153 A 4/1969 Lemme
3,645,573 A 2/1972 Strang
3,655,230 A 4/1972 Armstrong
3,706,467 A 12/1972 Martin
3,709,540 A 1/1973 Beilis
3,811,718 A 5/1974 Bates
3,907,348 A 9/1975 Bates
4,059,298 A 11/1977 Van Klompenburg
4,095,827 A 6/1978 Stavenau
4,095,829 A 6/1978 Van Klompenburg
4,227,345 A 10/1980 Durham, Jr.
4,261,602 A 4/1981 Anderson
4,305,612 A 12/1981 Hunt et al.
D268,643 S 4/1983 Anderson
4,558,174 A 12/1985 Massey
4,621,847 A 11/1986 Paulson
4,736,972 A 4/1988 Mosch
4,801,164 A * 1/1989 Mosch ..... 292/204
4,813,725 A 3/1989 Mosch
D302,651 S 8/1989 Mosch
4,961,286 A 10/1990 Bezubic
D316,509 S 4/1991 Nolte
5,042,855 A 8/1991 Bennett et al.
5,072,464 A 12/1991 Draheim et al.
5,076,015 A 12/1991 Manzalini
5,087,087 A 2/1992 Vetter
5,087,088 A 2/1992 Milam
5,090,750 A 2/1992 Lindqvist
5,110,165 A 5/1992 Piltingsrud
5,127,685 A 7/1992 Dallaire et al.
5,139,291 A 8/1992 Schultz
5,161,839 A 11/1992 Piltingsrud et al.
5,219,193 A 6/1993 Piltingsrud
5,398,447 A 3/1995 Morse
5,448,857 A 9/1995 Stormo
D366,409 S 1/1996 Delaske
5,582,445 A 12/1996 Olsen et al.
RE35,463 E 2/1997 Vetter et al.
5,715,631 A 2/1998 Kailian et al.
5,741,032 A 4/1998 Chaput
5,778,602 A 7/1998 Johnson
5,839,767 A 11/1998 Piltingsrud
5,901,499 A 5/1999 Delaske et al.
5,992,907 A 11/1999 Sheldon et al.
6,116,665 A 9/2000 Subliskey
6,142,541 A 11/2000 Rotondi
2002/0116874 A1 8/2002 Marshik

FOREIGN PATENT DOCUMENTS

GB 2026594 2/1980

* cited by examiner

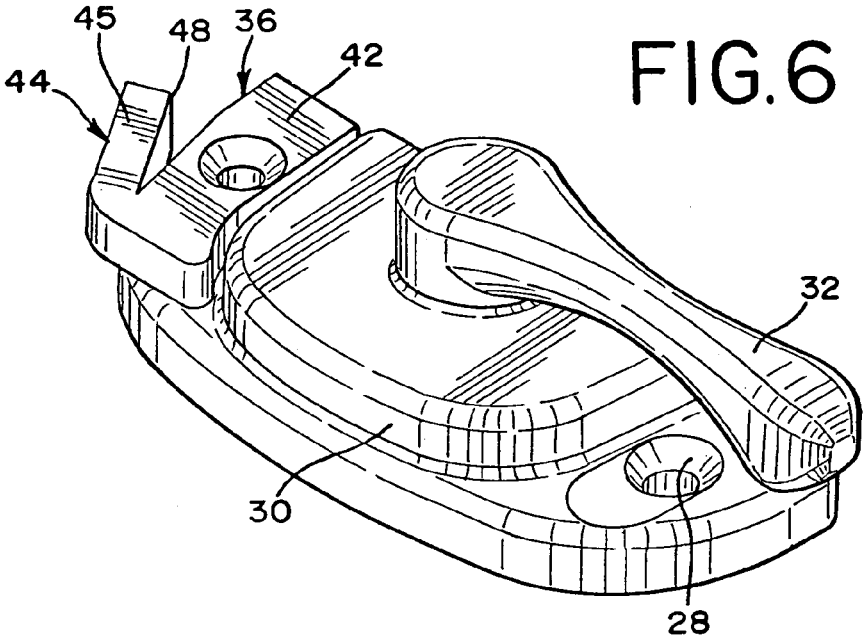
FIG.6
FIG.7
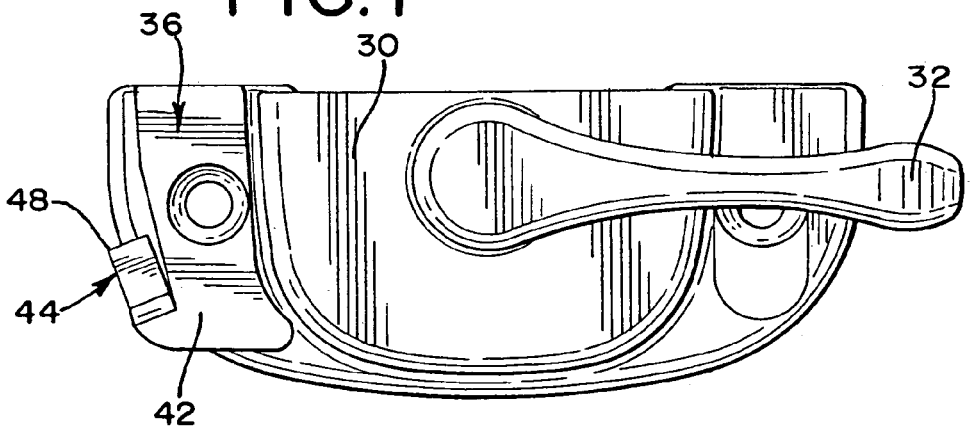
FIG.8
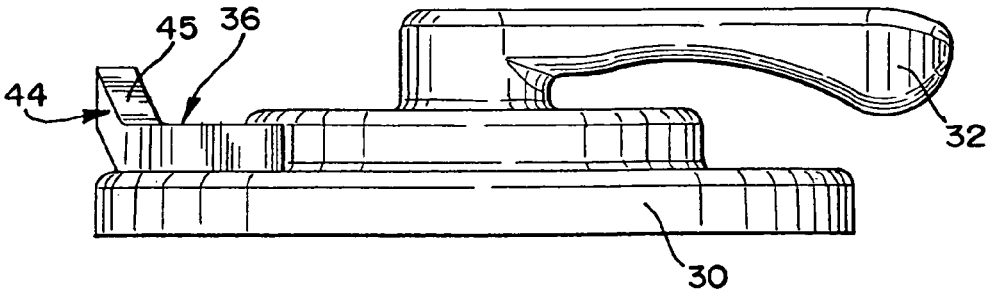

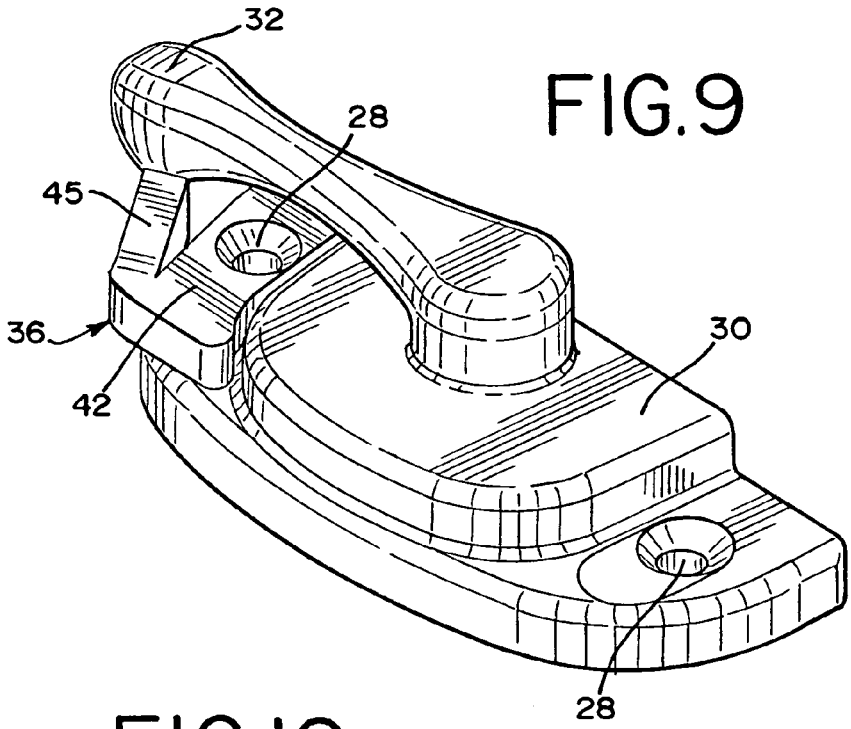
FIG.9
FIG.10
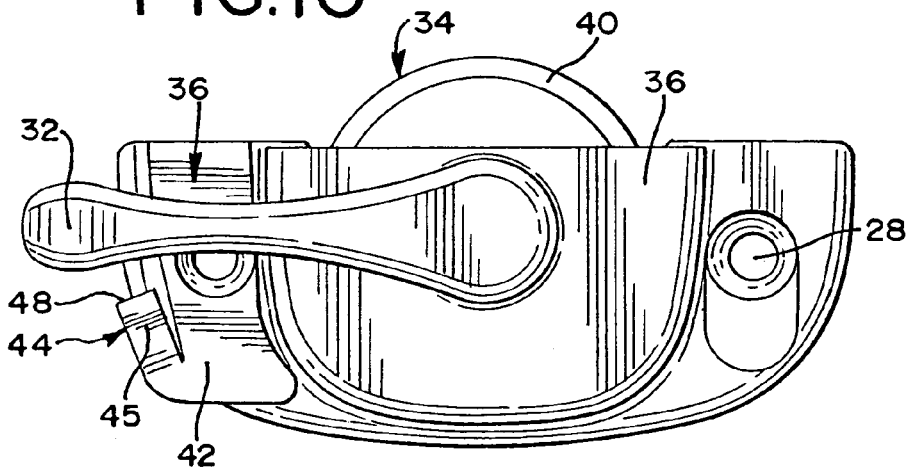
FIG.11
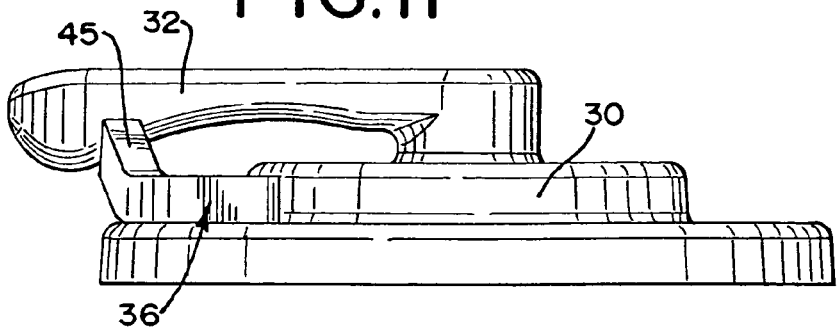

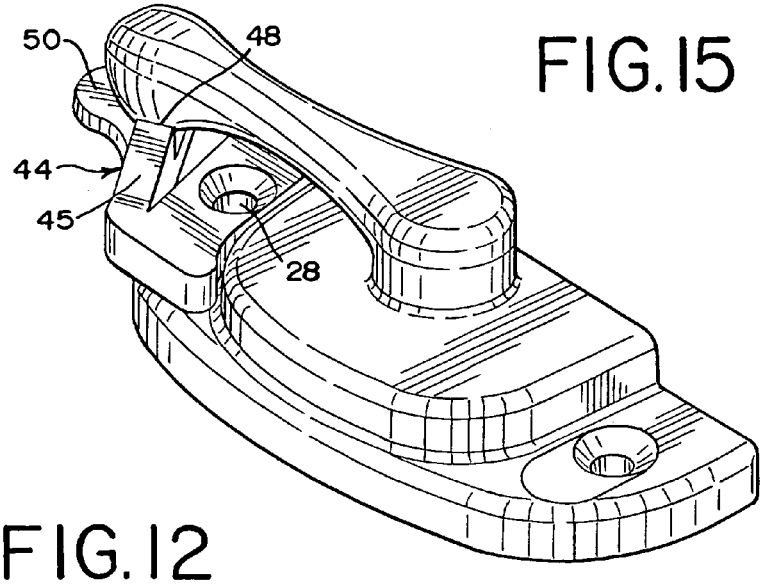
FIG. 15
FIG. 12
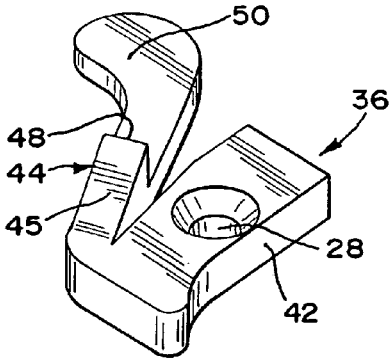
FIG. 13
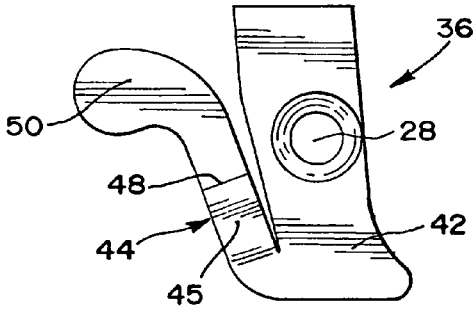
FIG. 14
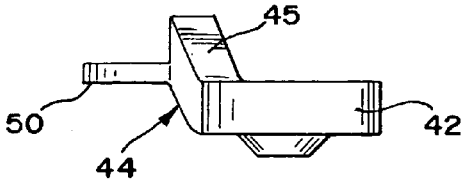

FORCED ENTRY RESISTANCE DEVICE FOR SASH LOCK

RELATED APPLICATIONS

This application claims the benefit of application Ser. No. 60/352,701, filed Jan. 29, 2002, which is expressly incorporated by reference herein and made a part hereof.

TECHNICAL FIELD

This invention relates to sash locks for slidable door or window assemblies. More particularly, it relates to a forced entry resistance device for a sash lock.

BACKGROUND OF THE INVENTION

Sash locks for double hung window assemblies are commonly known in the art. A double hung window assembly generally has an upper sash window and a lower sash window within a master frame. Typical sash locks draw opposed frame members of the sash windows together and lock the sashes preventing them from sliding within the master frame.

One problem associated with typical sash locks is their ability to be manipulated by an intruder from outside the window assembly. That is, sash locks generally include some type of rotatable actuator arm and cam. The actuator is rotatable from an unlocked to a locked position. With some sash locks, the actuator arm or cam may be manipulated from the outside by a skilled intruder using a thin knife, stiff wire, or other diabolical tool of intrusion.

The present invention is provided to solve these and other problems.

SUMMARY OF THE INVENTION

A sash lock for a sash window assembly is provided. The sash window assembly includes an upper sash window and a lower sash window, each of the sash windows mounted within opposed guide rails on a master frame, wherein at least one of the sash windows is slidable within the frame relative to the other sash window. The sash lock of the present invention includes a keeper adapted for mounting on a frame member of one of the sash windows. The keeper includes a keeper surface. The sash lock also includes a locking assembly adapted for mounting on an adjacent member of the other of the sash windows. The locking assembly comprises a housing having an aperture, an actuator arm rotatable between an unlocked position and a locked position and a cam having a cam surface for engaging the keeper surface. A shaft is also provided extending through the aperture and coupling the actuator arm to the cam such that the actuator arm and cam are rotatably mounted to the housing. A tab mounted to the housing is also provided wherein the tab engages the actuator arm to retain the actuator in its locked position. The tab can be deflected to allow the actuator arm to be moved to its unlocked position.

In an alternative embodiment the tab is integrally formed with the housing.

In an alternative embodiment the tab further comprises a thumb button.

Other features and advantages of the invention will be apparent from the remainder of this specification.

BRIEF DESCRIPTION OF THE DRAWINGS

FIG. 6 is a perspective view of a locking assembly of a sash lock of the present invention utilizing the resistance device;

FIG. 7 is a plan view of a locking assembly of the sash lock of the present invention utilizing the resistance device;

FIG. 8 is a front elevation of a locking assembly of the sash lock of the present invention utilizing the resistance device;

FIG. 9 is a perspective of a locking assembly of the sash lock of the present invention with its actuator arm in the locked position;

FIG. 10 is a plan view of the locking assembly of FIG. 9;

FIG. 11 is a front elevation of the locking assembly of FIG. 9;

FIG. 12 is a perspective of an alternative embodiment of a forced entry resistance device of the present invention;

FIG. 13 is a top view of the resistance device of FIG. 12;

FIG. 14 is a front elevation of the resistance device of FIG. 12;

FIG. 15 is a perspective of a locking assembly of the sash lock including the alternative embodiment of a resistance device of the present invention, with its actuator arm in the locked position.

DETAILED DESCRIPTION

Figure 1:
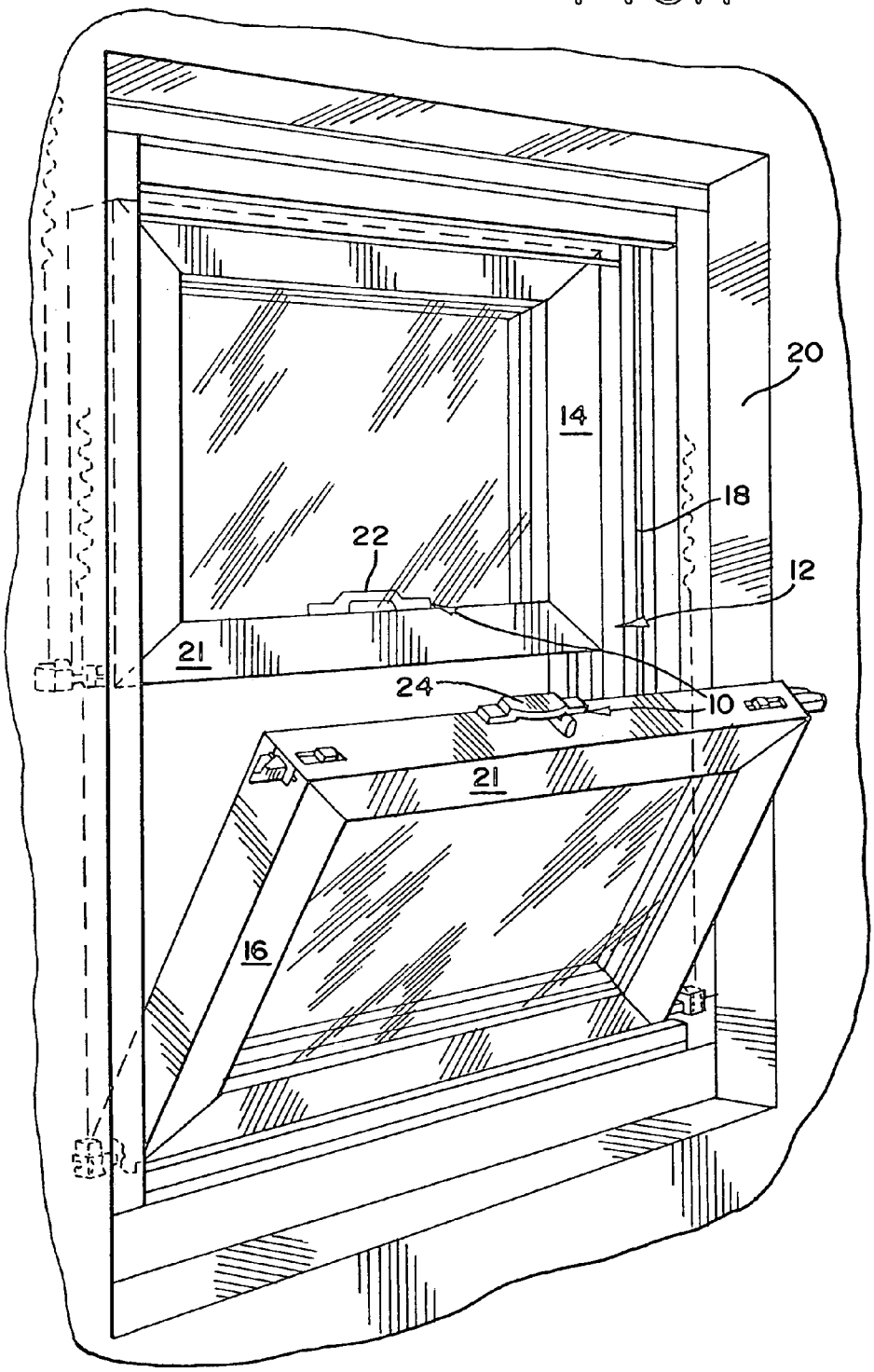
FIG. 1 is a perspective view of a sash window assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A sash lock 10 for a sash window assembly 12 is illustrated in the FIGURES. As generally shown in FIG. 1, the sash window assembly 12 includes an upper sash window 14 and a lower sash window 16. Each of the sash windows 14, 16 is mounted within opposed guide rails 18 on a master frame 20. At least one of the sash windows 14, 16 is slidable within the frame 20 relative to the other of the sash windows 14, 16. Each sash window 14, 16 has a pair of horizontal frame members 21.

The sash lock 10 includes a keeper 22 and a locking assembly 24. The keeper 22 includes a keeper surface (not shown) and a pair of mount holes (not shown) for mounting the keeper 22 to one of the frame members 21, as described more fully below.

Figure 2:
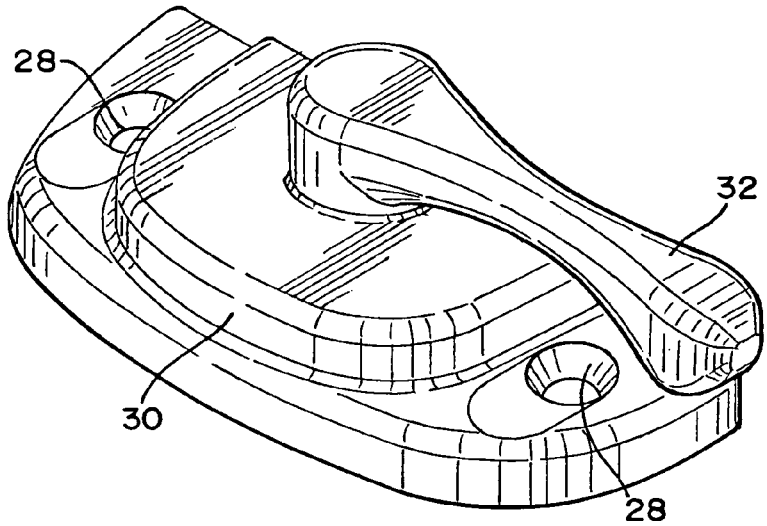
FIG. 2 is a perspective view of a locking assembly of a prior art sash lock.
Figure 3:
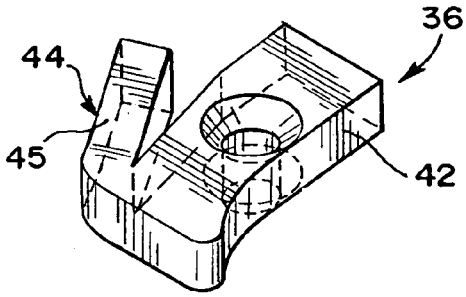
FIG. 3 is a perspective view of a forced entry resistance device of the present invention.
Figure 4:
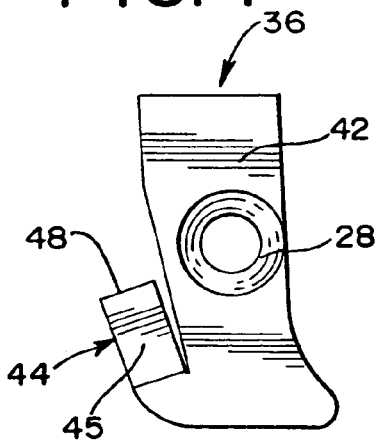
FIG. 4 is a plan view of the resistance device of the present invention.
Figure 5:
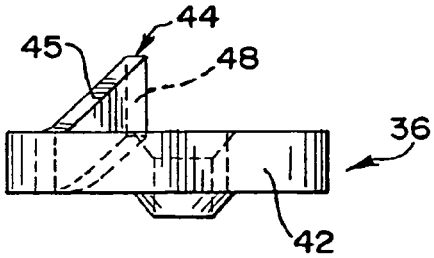
FIG. 5 is a side elevation of the resistance device of the present invention.

The locking assembly 24 of the present invention is shown in FIG. 6 and includes a housing 30, an actuator arm 32, a cam 34 (FIG. 10) and a forced entry resistance device or anti-rotation device 36. A locking assembly 24 of the prior art without the anti-rotation device 36, is shown in FIG. 2. The housing 30 includes a pair of mount holes 28 and an aperture 33. The cam 34 includes a cam surface 40 (FIG. 10) for engaging the keeper surface. A shaft 35 connects the cam 34 to the actuator arm 32 through the aperture. It is understood that the actuator arm 32 and the shaft 35 can be a single integral member. In this way, the cam 34 and actuator arm 32 are rotatably mounted to the housing 30. That is, there is no relative movement between the cam 34 and actuator arm 32, however, the cam 34 and actuator arm 32 together, rotate with respect to the housing 30.

The anti-rotation device 36 (FIGS. 3–8) includes a body 42 having an external tab 44. The body 42 is adapted for mounting to the housing 30 and includes a mount hole 43 for this purpose. The external tab 44 is generally rectangular in cross section and is resiliently flexible. The external tab 44 includes an inclined surface 45 and an engagement surface 48.

The actuator arm 32 of the locking assembly 24 is rotatable between an unlocked position (FIG. 6) and a locked position as shown in FIG. 10. In the unlocked position, the cam 34 is located completely within the housing 30. In the locked position, the cam 34 has rotated and its cam surface 40 is substantially external to the housing 30 to engage the keeper surface.

In the embodiment described, the keeper 22 is mounted to the lower frame member or base 21 of the upper sash window 14 (FIG. 1). The keeper 22 is mounted with a pair of screws or other fasteners extending through the mount holes and secured to the base 21. Typically, the keeper 22 is mounted near the center of the base 21.

The locking assembly 24 is mounted to the upper frame member of top rail 23 of the lower sash window 16. It is mounted such that it is immediately adjacent to the keeper 22 when the upper sash window 14 is in its upper most position within the frame 20 and the lower sash window 16 is in its lower most position within the frame 20. In mounting the locking assembly 24, a screw or other fastener (not shown) is passed through the mount hole 43 of the body 42 of the anti-rotation device 36. The screw is then passed through one of the mount holes 28 of the locking assembly 24 and secured to the top rail 23. (See FIG. 6). Another screw or fastener is then used to secure the housing 30 to the top rail 23 via its other mount hole 28. In this way, the anti-rotation device 36 is secured to the housing 30 and the housing is secured to the upper stile 21 of the lower sash window 16. It is not important to which mount hole 28 of the housing 30 the anti-rotation device 36 is secured. It is important that the anti-rotation device 36 is in a position to be immediately adjacent to the actuator arm 32 when the actuator arm 32 is in its locked position.

For instance, the locking assembly 24 depicted in the FIGURES is configured such that the actuator arm 32 rotates in a clockwise direction when rotating from the unlocked to the locked position. However, it is understood that the locking assembly 24 may be configured such that its actuator arm 32 rotates in a counter-clockwise direction in moving from the unlocked to the locked position. In this instance, the device 36 would be mounted to the other mounting hole 28 of the housing 30 than shown in the FIGURES.

In operation, with the actuator arm 32 in the unlocked position, the upper sash window 14 is raised to its upper most position within the frame 20 and the lower sash window 16 is lowered to its lower most position within the frame 20. This brings the locking assembly 24 to a position immediately adjacent the keeper 22. FIGS. 6–8 show the locking assembly 24 with the actuator arm 32 in the unlocked position. The actuator arm 32 is then rotated towards it locked position. This rotates the cam 34 to a position external to the housing 30 and causes the cam surface 40 to engage the keeper surface, in a manner commonly known to those of ordinary skill in the art. As the actuator arm 32 approaches the locked position, the arm 32 engages the inclined surface 45 of the external tab 44 slightly depressing the tab 44. Engagement of actuator arm 32 with the inclined surface 45 of the tab 44 depresses the tab 44 into a deflected position (arrow A in FIGS. 9 and 11). While the tab 44 is in the deflected position, the actuator arm 32 is allowed to pass by the tab 44. Once the actuator arm 32 passes by the tab 44, the tab 44 resiliently snaps back from its deflected position to the engagement position wherein the engagement surface 48 of the tab 44 confronts the actuator arm 32 to prevent rotation of the arm 32 back to its unlocked position. While in the engagement position, if the actuator arm 32 is rotated towards its unlocked position, the engagement surface 48 will engage the actuator arm 32 preventing rotation. FIGS. 9–11 show the locking assembly 24 with the actuator arm 32 in the locked position.

To rotate the actuator arm 32 back to its unlocked position, the tab 44 must be depressed, such as by a user's thumb or other finger. This deflects the tab 44 in the direction of arrow A and disengages or moves the engagement surface 48 from the rotational path of the actuator arm 32 and allows rotation of the same. While the tab 44 is depressed to a deflected position, the actuator arm 32 is rotated past the tab 44 to its unlocked position.

In an additional embodiment of the invention shown in FIGS. 12–15, the anti-rotation device 36 includes a thumb button 50. The thumb button 50 is connected at one end to an under side of the external tab 44. Another end of the thumb button 50 is curved and extends away from the housing 30. The thumb button 50 improves the ease with which a user may depress the tab 44 to allow the actuator arm 32 to be moved from the locked to the unlocked position.

Although the invention has been described as being applied to a vertically sliding double hung window, it is understood the invention can equally be applied to horizontally sliding sash window arrangements or any operable sash window that slides within a frame.

Figure 16:
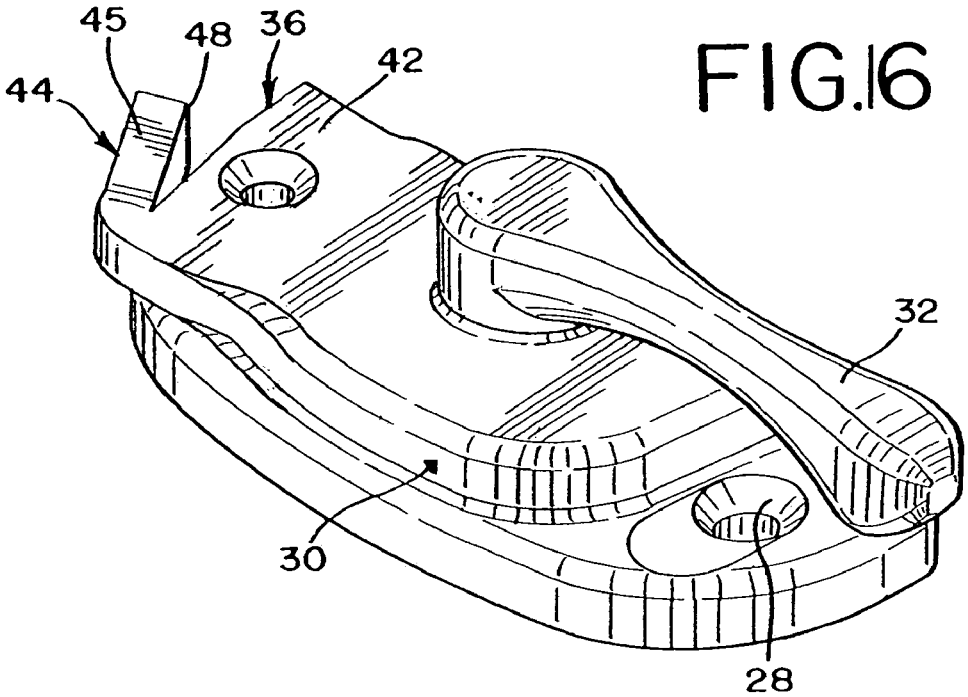
FIG. 16 is a perspective view of a sash lock housing showing an alternative embodiment of a forced entry resistance device according to the present invention.

Additionally, although not shown in the drawings, it will be understood by those of ordinary skill in the art, that the anti-rotation device 36 may be integrally formed with the housing 30 while remaining within the scope of the present invention. (See FIG. 16.) Furthermore, it is understood that the resistance or anti-rotation device 36 may be formed from any number of materials of sufficient strength to withstand the forces involved in an attempted rotation of the actuator arm 32 by an intruder, while remaining resiliently flexible enough to allow depression of the external tab 44 by the user. For example, the device 36 may be formed from various metals and alloys thereof as commonly known, providing the required strength and resilience.

It is also understood that the resistance device 36 may take other forms. For example, the device may be a spring biased tab, or pop-up button that similarly interferes with the path of rotation of the actuator arm 32 from the locked to the unlocked position. These alternatives remain within the scope of this invention.

It can be appreciated that the device 36 of the present invention will prevent simple rotation of the actuator arm 32 without additional manipulation of the device 36. The device 36, while not intruder-proof, will provide significant deterrence to forced entry and unwanted manipulation of the sash lock 10 from outside the sash window assembly 12. It can further be appreciated that as the device 36 is external to the housing 30 of the locking assembly 24, an embodiment of the device 36 may be adapted for retrofitting to existing sash lock 10 installations currently in use. This purpose and others are served by a simplicity of construction and an external nature of the device 36, not previously known in the art.

While the specific embodiments and various details thereof have been illustrated and described, numerous modifications come to mind without significantly departing from the spirit of the invention and the scope of protection is only limited by the following claims.

We claim:

1. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper adapted for mounting on one of the sash windows, the keeper including a keeper surface; and a locking assembly adapted for mounting on the other of the sash windows, the locking assembly comprising:

a cam supported by the other of the sash windows, the cam having a cam surface for engaging the keeper surface;

an actuator arm rotatable between an unlocked position and a locked position; the actuator arm operably connected to the cam;

a housing having an aperture;

a shaft extending through the aperture and coupling the actuator arm to the cam such that the actuator arm and cam are rotatably supported by the housing; and a body integrally formed with the housing, the body having a tab having a first end mounted to the body and a second free end extending away from the first end wherein the tab confronts the actuator arm to retain the actuator in its locked position.

2. The sash lock of claim 1 wherein the tab has a deflected position to allow rotation of the actuator arm to the unlocked position.

3. The sash lock of claim 1 wherein the tab has a thumb button extending therefrom.

4. The sash lock of claim 1 wherein the tab has an engagement surface adapted to abut the actuator arm.

5. The sash lock of claim 1 wherein the tab has an engagement position wherein the tab abuts the actuator arm.

6. The sash lock of claim 5 wherein the tab has a deflected position wherein the actuator arm can rotate from the locked position to the unlocked position.

7. The sash lock of claim 6 wherein the tab has an inclined surface.

8. The sash lock of claim 7 wherein the actuator arm slides along the inclined surface when moving from the unlocked position to the locked position wherein the tab moves to the deflected position.

9. The sash lock of claim 8 where in the tab moves to the engagement position after the actuator arm moves past the tab.

10. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper adapted for mounting on one of the sash windows, the keeper including a keeper surface; and a locking assembly comprising:

a housing having a housing mount hole adapted for receiving a fastener for fastening the housing to the other of the sash windows, the housing further having an aperture;

a cam having a cam surface for engaging the keeper;

an actuator arm rotatable between an unlocked position and a locked position;

a shaft extending through the aperture and coupling the actuator arm to the cam such that the actuator arm and cam are rotatably supported by the housing; and an anti-rotation device having a base with a base mount hole adapted to receive the fastener, the body further having a tab integrally formed with the housing, the tab having a free end with a surface adapted to selectively engage the actuator arm to prevent rotation of the actuator arm from the locked position to the unlocked position, the tab further having a thumb button having a first end attached to the tab and a second end extending away from the tab.

11. The sash lock of claim 10 wherein the second end of the thumb button is curved.

12. The sash lock of claim 10 wherein the first end of the thumb button is attached to an underside of the tab.

13. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper adapted for mounting on one of the sash windows, the keeper including a keeper surface; and a locking assembly comprising:

a fastener;

a housing having a housing mount hole that receives the fastener to secure the housing to the other of the sash windows, the housing further having an aperture;

a cam having a cam surface for engaging the keeper and located in an interior of the housing;

an actuator arm rotatable between an unlocked position and a locked position;

a shaft extending through the housing aperture and coupling the actuator arm to the cam such that the actuator arm and cam are rotatably supported by the housing; and an anti-rotation device having a base with a base mount hole cooperatively positioned with the housing mount hole to receive the fastener, the device further having a resiliently deflectable tab with an inclined free end extending from the base, the free end having a terminal end wall that selectively engages the actuator arm to prevent rotation of the actuator arm from the locked position to the unlocked position.

14. The sash lock of claim 13 wherein the tab further has a thumb button having a first end attached to the tab and a second end extending away from the tab, the base further being mounted to an exterior of the housing.

15. The sash lock of claim 13 wherein the end wall of the tab has a planar configuration, the end wall confronting a portion of the actuator arm in the locked position.

16. The sash lock of claim 13 wherein the resilient tab is moveable to a deflected position to permit the actuator arm to move between the locked and unlocked positions.

17. The sash lock of claim 16 wherein in the deflected position, a portion of the actuator arm slidingly engages the tab as the actuator arm moves between the locked and unlocked positions.

18. The sash lock of 16 wherein the tab moves from the deflected position to an engagement position after the actuator arm moves past the tab.

* * * * *